US006564422B2

(12) United States Patent
Nakabayashi

(10) Patent No.: US 6,564,422 B2
(45) Date of Patent: May 20, 2003

(54) VACUUM CLEANER HAVING A COMMON VALVE TO CONTROL MULTIPLE OPERATIONS

(75) Inventor: Masakazu Nakabayashi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/974,857

(22) Filed: Oct. 12, 2001

(65) Prior Publication Data

US 2002/0189047 A1 Dec. 19, 2002

(30) Foreign Application Priority Data

Jun. 13, 2001 (JP) ..... 2001-178289

(51) Int. Cl.[7] ..... A47L 5/02
(52) U.S. Cl. ..... 15/344; 15/341
(58) Field of Search ..... 15/344, 341; 141/61, 141/66; 215/262; 220/231

(56) References Cited

U.S. PATENT DOCUMENTS 3,965,608 A * 6/1976 Schuman ..... 15/341
4,570,685 A * 2/1986 Taylor ..... 141/61
5,555,601 A * 9/1996 Schultz ..... 15/344

FOREIGN PATENT DOCUMENTS

| | | |
|---|---|---|
| JP | 51-45905 | 12/1976 |
| JP | 55-155619 | 12/1980 |
| JP | 56-83320 | 7/1981 |
| JP | 64-7510 | 1/1989 |

* cited by examiner

*Primary Examiner*—Theresa T. Snider
(74) *Attorney, Agent, or Firm*—Oblon, Spivak, McClelland, Maier & Neustadt, P.C.

(57) ABSTRACT

A vacuum cleaner is provided which has a simple structure and exerts suction without involving discharge of gas at all so that it can be used in extremely clean environments. A vacuum cleaner (100) comprises a vacuum tank (1) which is previously evacuated to create a vacuum inside, a valve (2) for keeping the vacuum tank 1 airtight, and a suction unit (20) attached to the valve (2); the valve (2) is opened when the vacuum cleaner (100) is used. The valve (2) is a so-called gate valve and the vacuum tank (1) is kept airtight when the gate valve element (22) in the valve (2) is closed. A connection inlet (23) is attached to the valve (2) on the side opposite to its surface attached to the vacuum tank (1). A connection adapter (31) is screwed into the connection inlet (23) and an attachment, e.g. a flexible suction hose (32), is attached to the connection adapter (31).

6 Claims, 7 Drawing Sheets

VACUUM CLEANER HAVING A COMMON VALVE TO CONTROL MULTIPLE OPERATIONS

BACKGROUND OF THE INVENTION

1. Field of the Invention

The present invention relates to a vacuum cleaner, and particularly to a vacuum cleaner which exerts suction without involving discharge of gas.

2. Description of the Background Art

Most conventional vacuum cleaners adopt the system in which dirt and dust particles are sucked up by a suction force produced as a fan attached to a motor rotates, where air is discharged as the fan rotates. It is therefore unavoidable that part of the collected particles are emitted with the discharged air and that the air blows off and scatters dirt and dust particles lying around it.

Some vacuum cleaners which manually create a vacuum adopt the system in which a suction inlet is attached to a flexible container which contracts and expands like an accordion, where the volume of the flexible container is manually expanded to create a low vacuum in the container, so that the pressure difference from the external pressure forces dirt and dust particles into the suction inlet. However, in this system, using the vacuum cleaner again requires contracting the flexible container again, in which process the internal air is discharged, causing the collected particles to escape or blowing off particles.

Motor-driven vacuum cleaners discharging a reduced amount of air are being developed in these days. They encounter no problem when used in ordinary environments, as in a house or an office; however, they cannot be used in extremely clean environments, such as a clean room in a semiconductor device manufacturing factory, because they still discharge a slight amount of air.

In a clean room, for example, a special cleaner is used which is designed to guide the discharged gas to the outside of the clean room. Such cleaners are large in scale and require equipment such as an air duct installed under the floor of the clean room.

SUMMARY OF THE INVENTION

According to a first aspect of the present invention, a vacuum cleaner comprises: a vacuum tank which is previously evacuated to create a vacuum with an evacuating system, the vacuum tank, after evacuation, being independent of the evacuating system and kept at a pressure lower than atmospheric pressure; a first valve connected to an opening of the vacuum tank, the first valve, when closed, keeping the vacuum tank airtight; and a suction unit defining a passage of gas which, when the first valve is opened, is sucked into the vacuum tank because of a pressure difference between the inside and outside of the vacuum tank.

Preferably, according to a second aspect, in the vacuum cleaner, the suction unit is connected to the first valve and the first valve has an adjustable opening, and wherein the suction force for sucking the gas into the suction unit is adjusted by adjusting the adjustable opening of the first valve.

Preferably, according to a third aspect, in the vacuum cleaner, the first valve is a gate valve in which the adjustable opening is adjusted by adjusting the area in which its gate valve element covers the adjustable opening.

Preferably, according to a fourth aspect, the vacuum cleaner further comprises a second valve provided upstream of the first valve in the passage of the gas and the second valve has an adjustable opening, wherein the suction unit is connected to the second valve and the suction force for sucking the gas into the suction unit is adjusted by adjusting the adjustable opening of the second valve.

Preferably, according to a fifth aspect, in the vacuum cleaner, the second valve is a gate valve in which the adjustable opening is adjusted by adjusting the area in which its gate valve element covers the adjustable opening.

The vacuum cleaner according to the first aspect of the present invention creates a suction force through a difference between the external atmospheric pressure and the pressure lower than the atmospheric pressure in the vacuum tank which is independent of the evacuating system, thus sucking up dirt and dust particles through the suction unit. The suction therefore does not involve discharge of gas at all and can be used in extremely clean environments. Furthermore, the structure for creating the suction force is formed just of the vacuum tank, providing a simply-structured compact vacuum cleaner.

According to the vacuum cleaner of the second aspect, the first valve is a valve which can be adjusted to adjust the state of the opening and the suction force for sucking the gas can be adjusted by adjusting the opening formed by the first valve. Accordingly, even though the volume of the vacuum tank is limited, the duration of the suction can be lengthened by adjusting the suction force.

According to the vacuum cleaner of the third aspect, the first valve is a gate valve which can provide a relatively large opening area and can be formed thinner in the direction of the gas passage. This offers a compact vacuum cleaner.

The vacuum cleaner of the fourth aspect comprises a second valve which is provided upstream of the first valve and can be adjusted to adjust the state of the opening, and a simply structured valve which is just opened and closed can be used as the first valve. When replacing the vacuum tank with a new one, the first valve and the vacuum tank can be removed/attached together from/to the second valve, which structure reduces the running cost.

According to the vacuum cleaner of the fifth aspect, the second valve is a gate valve which can provide a relatively large opening area and can be formed thinner in the direction of the gas passage. This offers a compact vacuum cleaner.

The present invention was made to solve the problem explained earlier, and an object of the present invention is to provide a vacuum cleaner which has a simple structure and exerts suction without involving discharge of gas at all so that it can be used in extremely clean environments.

These and other objects, features, aspects and advantages of the present invention will become more apparent from the following detailed description of the present invention when taken in conjunction with the accompanying drawings.

DESCRIPTION OF THE PREFERRED EMBODIMENTS

A vacuum cleaner according to the present invention has a vacuum tank with a valve provided at its opening; the inside of the vacuum tank is kept at pressure lower than atmospheric pressure. When the valve is opened, the pressure difference between the inside and outside creates a suction force to suck up dirt and dust particles.

A preferred embodiment of the vacuum cleaner of this invention is now described referring to FIGS. 1 to 8.

<A. Device Structure>

Figure 1:
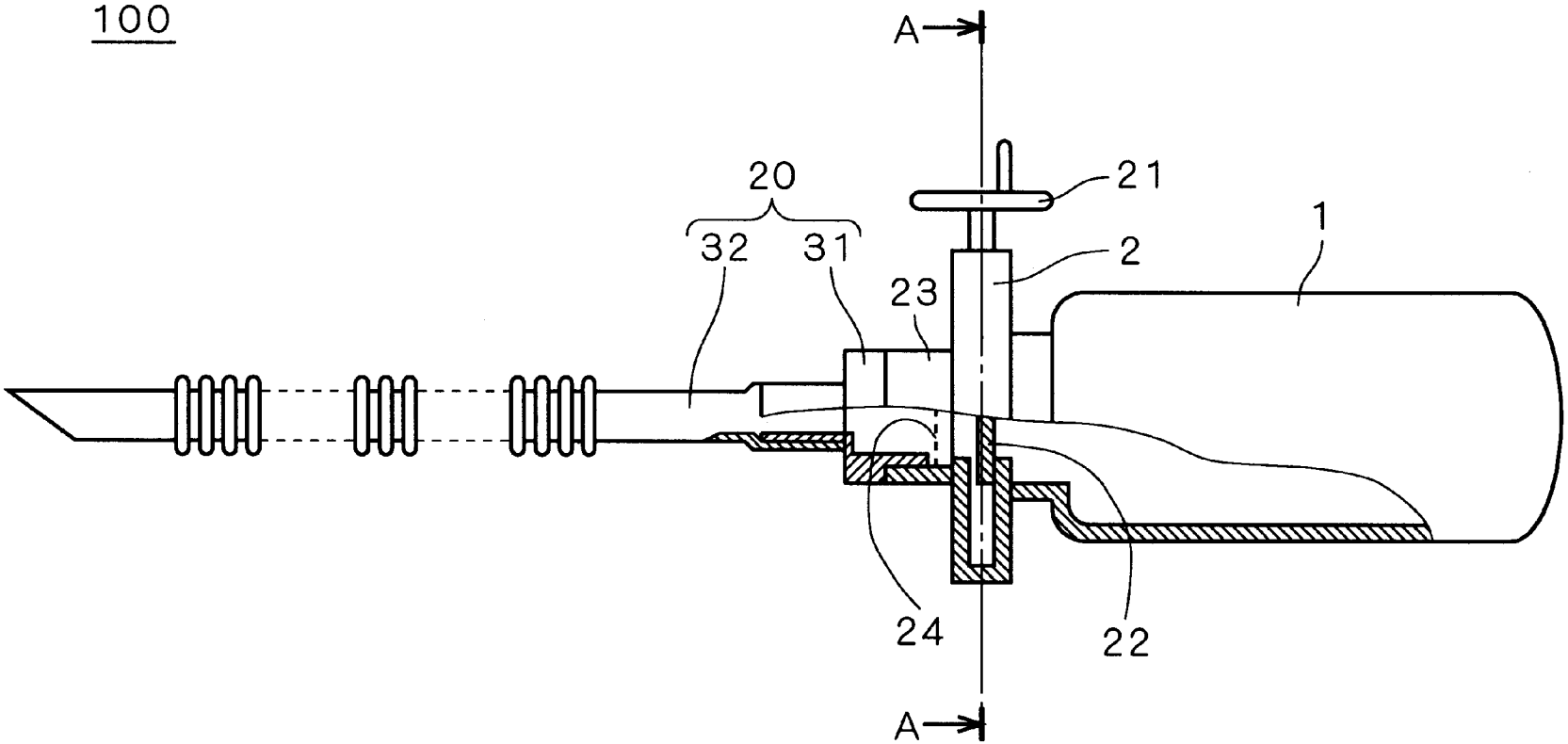
FIG. 1 is a diagram showing a vacuum cleaner according to a preferred embodiment of the present invention.

First, FIG. 1 shows the entire structure of a vacuum cleaner 100 of this invention. In FIG. 1, the vacuum cleaner 100 comprises a vacuum tank 1 which is previously evacuated to create a vacuum inside, a valve 2 which is fixed to an opening of the vacuum tank 1 and keeps the vacuum tank 1 airtight, and a suction unit 20 attached to the valve 2; the valve 2 is opened when the vacuum cleaner 100 is used.

The valve 2 is a so-called gate valve. When a gate valve element 22 of the valve 2 is closed, the opening of the vacuum tank 1 is covered so that the inside of the vacuum tank 1 is kept airtight. The gate valve element 22 is opened/closed through operation of the handle 21. When the handle 21 is rotated to open the gate valve element 22 in the valve 2, the difference between the pressure in the vacuum tank 1 and the external pressure creates a suction force. The suction force can be adjusted by adjusting rotation of the handle 21 to adjust the state of the opening formed by the gate valve element 22.

A connection inlet 23 is attached to the main surface of the valve 2 on the side opposite to its main surface attached to the vacuum tank 1. A connection adapter 31 is screwed into the connection inlet 23 and an attachment, e.g. a flexible suction hose 32, is attached to the connection adapter 31. The connection adapter 31 and the suction hose 32 form the suction unit 20.

Figure 2:
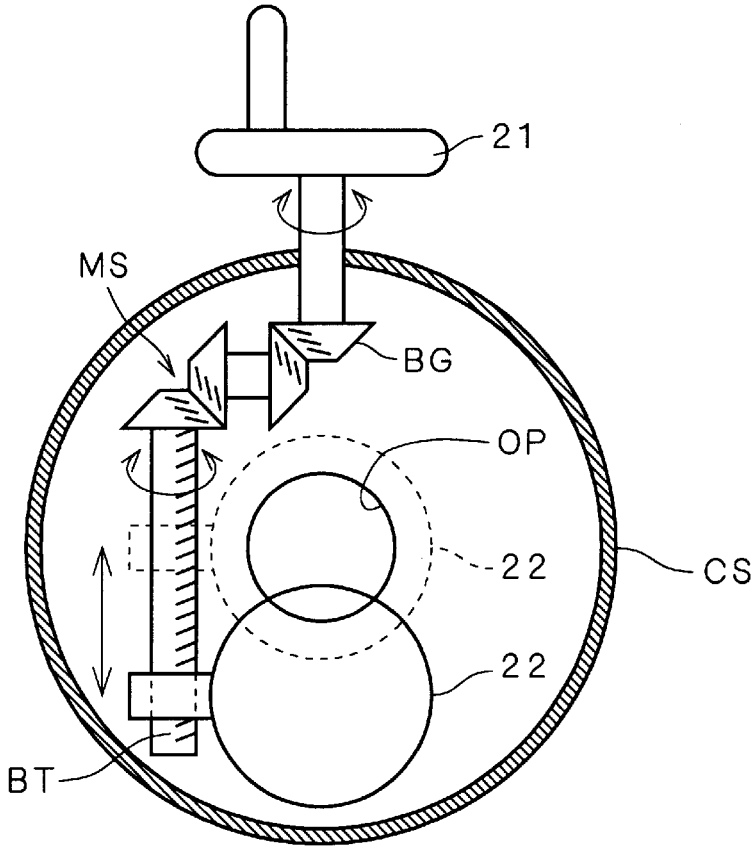
FIG. 2 is a diagram showing the structure of the valve of the vacuum cleaner of the preferred embodiment of the invention.

Next, an example of the structure of the valve 2 is described referring to FIG. 2. FIG. 2 shows the cross section taken along the line A—A in FIG. 1. As shown in FIG. 2, the valve 2 has a disk-like gate valve element 22 which is sized large enough to close the circular opening OP (adjustable opening) formed on the side of the vacuum tank 1. A seal member not shown (e.g. an O ring) is provided in the main surface of the gate valve element 22 which faces the opening OP; when the main surface of the gate valve element 22 is located to completely cover the opening OP, the seal member comes in close contact with the inner flat surface of the case CS of the valve 2 and keeps the vacuum tank 1 airtight.

The gate valve element 22 is connected to a driving mechanism MS which converts rotation of the handle 21 to linear movement, so that the gate valve element 22 can be slid in parallel with the opening OP. When the gate valve element 22 is slid over the opening OP, the airtightness of the vacuum tank 1 is broken, and the effective area of the opening OP increases as the gate valve element 22 shifts off the opening OP.

The effective area of the opening OP can thus be varied by adjusting the amount of shift of the gate valve element 22 off the opening OP. For this reason, the opening OP is called an adjustable opening.

A valve other than a gate valve can be used as the valve 2 as long as it can adjust the state of the opening to adjust the suction force. The gate valve can provide a larger opening area than other valves and can be formed thinner in the direction in which gas flows, so that using the gate valve enables a more compact vacuum cleaner.

As a simplest possible structure of the driving mechanism MS, as shown in FIG. 2, the rotation force of the handle 21 is given through a plurality of bevel gears BG to a ball thread BT provided in parallel with the direction in which the gate valve element 22 is slid, where the gate valve element 22 engaging with the ball thread BT is linearly slid as the ball thread BT rotates. Needless to say, the mechanism for driving the gate valve element 22 is not limited to this structure; any mechanism can be used as long as it can slide the gate valve element 22.

Figure 3:
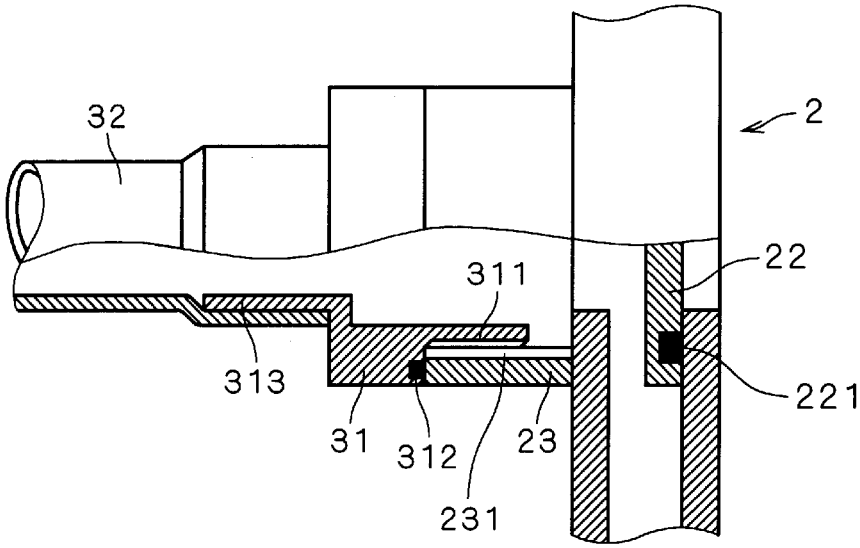
FIG. 3 is a partially sectional view showing the structure of part of the vacuum cleaner of the preferred embodiment of the invention.

Next, the structure of the connection inlet 23 and that of the connection adapter 31 are described referring to FIG. 3. FIG. 3 is a partially sectional view showing the structure of the connection inlet 23, including the valve 2, and the connection adapter 31.

As shown in FIG. 3, the connection inlet 23, formed in a cylindrical shape, has a screw 231 formed on its inner periphery. The connection adapter 31, also formed in a cylindrical shape, has a screw 311 formed on its outer periphery. The screw 311 (male screw) of the connection adapter 31 is engaged with the screw 231 (female screw) of the connection inlet 23 to connect the connection adapter 31 to the connection inlet 23.

The diameter of the connection adapter 31 in the part where the screw 311 is formed is smaller than the diameter of other part, so that a step is formed on the two parts. A seal member (e.g. an O ring) 312 is provided along the step, i.e. in the part surrounding the screw 311. When the connection adapter 31 is screwed in, the seal member 312 comes in close contact with the end of the connection inlet 23 and keeps the airtightness between the connection inlet 23 and the connection adapter 31.

The connection inlet 23 and the connection adapter 31 may be connected in the opposite relation. That is to say, the connection adapter 31 may be screwed over the connection inlet 23 with the screw 231 formed on the outer periphery of the connection inlet 23 and the screw 311 formed on the inner periphery of the connection adapter 31.

The opening of the connection adapter 31, formed on the side apart from the screw 311, protrudes as an attachment inlet 313 to which the suction hose 32 is attached. In this example, the suction hose 32 is made of an elastic resin and has an inside diameter somewhat smaller than the outside diameter of the attachment inlet 313, and is fitted over the attachment inlet 313 and thus tightly connected to the attachment inlet 313. However, this is just an example and other structures can be adopted; for example, the suction hose 32 and the connection adapter 31 may be screwed together, or the suction hose 32 may be detachably connected to a one-touch coupling, e.g. a quick disconnect joint, provided in place of the attachment inlet 313.

FIG. 3 also shows a seal member 221, e.g. an O ring, provided on the edge of the main surface of the gate valve element 22 on the side facing the opening OP.

Figure 4:
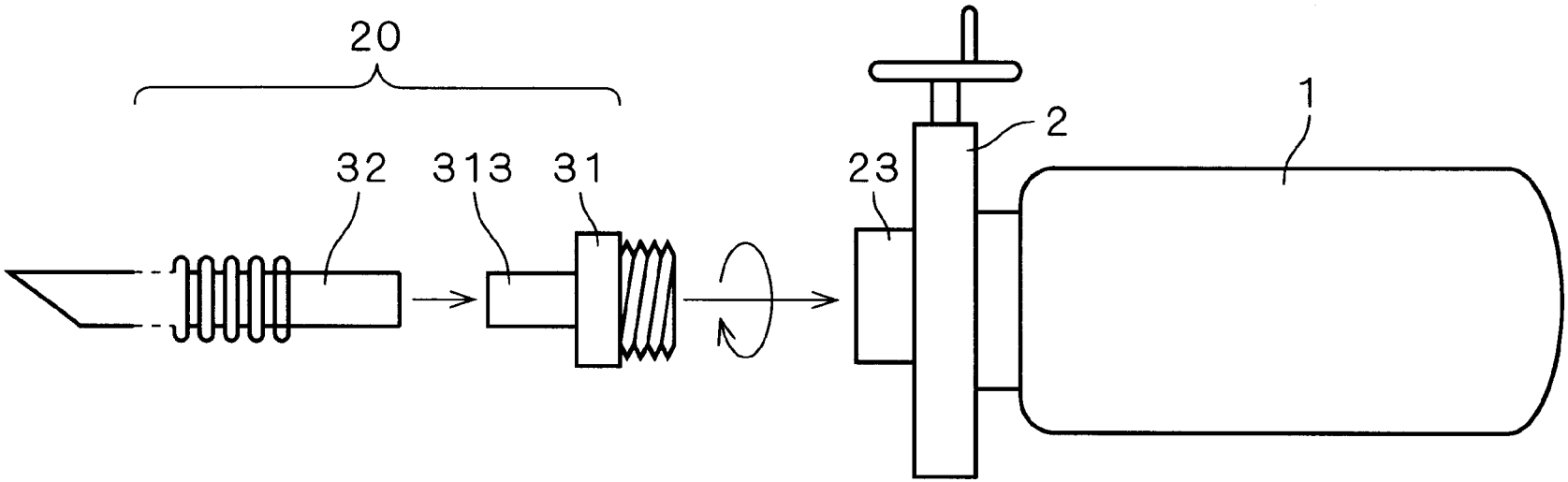
FIG. 4 is a diagram showing the assembly of the vacuum cleaner of the preferred embodiment of the invention.

FIG. 4 shows the connection between the valve 2 and the suction unit 20, where the connection adapter 31 is screwed into the connection inlet 23 of the valve 2 and the suction hose 32 is fitted over the attachment inlet 313 of the connection adapter 31.

<B. Device Operation>

Figure 5:
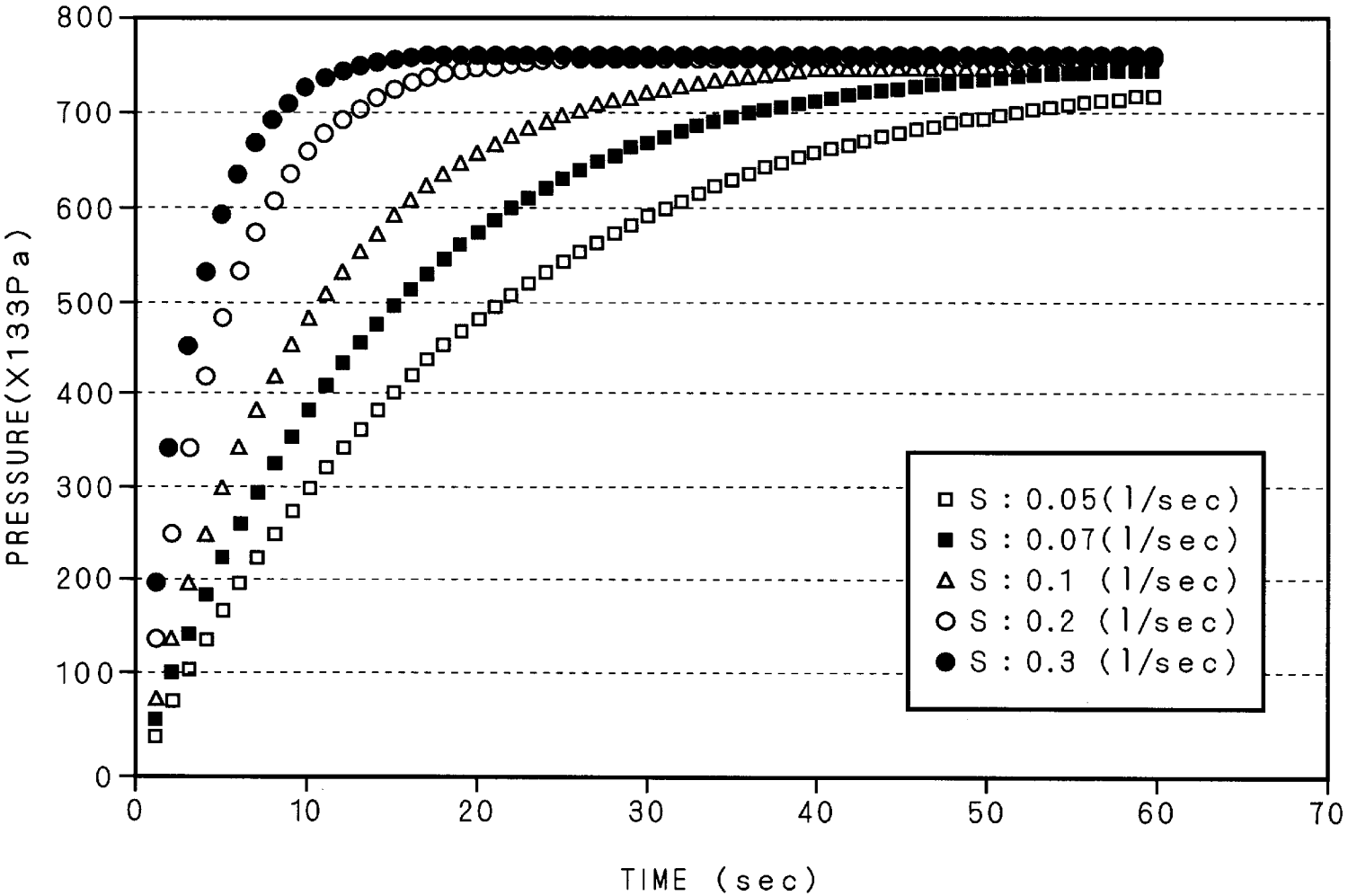
FIG. 5 is a diagram showing pressure variations in the vacuum tank with respect to the passage of time.

Next, the operation of the vacuum cleaner 100 is described referring to FIG. 5. As already mentioned, the vacuum cleaner 100 creates a suction force through a difference between the pressure in the vacuum tank 1 and the external pressure to suck up target particles. Accordingly the duration of the suction force is determined by the volume of the vacuum tank 1 and the opening area formed by the gate valve element 22 in the valve 2; the suction time is thus limited.

FIG. 5 is a diagram showing variations of the pressure in the vacuum tank (vertical axis) with respect to the passage of time (horizontal axis). This diagram shows actual data on the pressure variations measured with varying opening ratio of an adjusting valve corresponding to the gate valve element 22 and hence with varying volume of suction (S) per unit time.

That is to say, in FIG. 5, the curve shown with white squares (□) shows the pressure variation with the volume of suction (S) of 0.05 l/sec, the curve shown with black squares (■) shows the pressure variation with the volume of suction (S) of 0.07 l/sec, the curve shown with white triangles (Δ) shows the pressure variation with the volume of suction (S) of 0.1 l/sec, the curve shown with white circles (○) shows the pressure variation with the volume of suction (S) of 0.2 l/sec, and the curve shown with black circles (●) shows the pressure variation with the volume of suction (S) of 0.3 l/sec.

The vacuum tank used in this experiment had a volume of 1 liter (l) and the data shows the pressure variations measured while the pressure in the vacuum tank, set at $1\times10^{-4}\times133$ Pa at first, returns to atmospheric pressure ($760\times133$ Pa) when the adjusting valve is opened.

As shown in FIG. 5, the pressure varies most gently when S=0.05 l/sec, where the pressure in the vacuum tank does not regain atmospheric pressure even when 60 seconds have passed after the adjusting valve was opened. On the other hand, the pressure varies most rapidly when S=0.3 l/sec, where the pressure in the vacuum tank regains atmospheric pressure in about 10 seconds after the adjusting valve is opened. Other characteristics exist between the characteristic with S=0.05 l/sec and that with S=0.3 l/sec.

The suction time thus varies depending on the degree to which the adjusting valve is opened; suction is disabled in 60 seconds at longest and 20 seconds at shortest. Considering the suction force from a practical point of view, it is desirable to set the volume of suction at around 0.1 l/sec, in which case the suction time is about 20 seconds.

The suction time can be increased by using a vacuum tank with a larger volume; when a vacuum tank having a volume of about 3 liters is used, the suction force, when simply calculated, can be maintained for at least 1 minute.

The suction time of 1 minute is insufficient for usual cleaning. However, the vacuum cleaner 100 is intended for use in extremely clean environments like a clean room, where no dirt and dust particles originally exist.

Accordingly, the dirt or dust particles exist in very small amounts. The suction time of 1 minute is therefore effective for purposes in which the suction is conducted in a limited place and completed in a very short time. For example, when a wafer is broken and scattered in a wafer load-lock chamber in a semiconductor manufacturing system, it can be used to suck up pieces which are so small that an operator cannot collect by hand.

When the particles are small, a small suction force (the volume of suction per unit time) is sufficient, and the suction time can be further lengthened by adjusting the state of the opening formed by the gate valve element 22.

The suction time can be substantially unlimited when a plurality of vacuum tanks 1 are prepared and one vacuum tank 1 having become useless is replaced by a new one to continue the suction work.

Particles collected in the vacuum tank 1 are not released as long as the pressure in the vacuum tank 1 is negative. When the pressure in the vacuum tank 1 returned to atmospheric pressure, the valve 2 is closed to prevent the particles from escaping.

When a filter 24 is provided in the connection inlet 23 as shown in FIG. 1, it is possible to prevent dirt and dust particles larger than the meshes of the filter 24 from coming into the valve 2 and the vacuum tank 1. However, if the mesh size of the filter 24 is too small, the conductance is reduced and a desired suction force cannot be obtained when the gate valve element 22 is opened. The mesh size of the filter 24 is therefore determined considering the trade-off between the suction force and the filtering.

Figure 6:
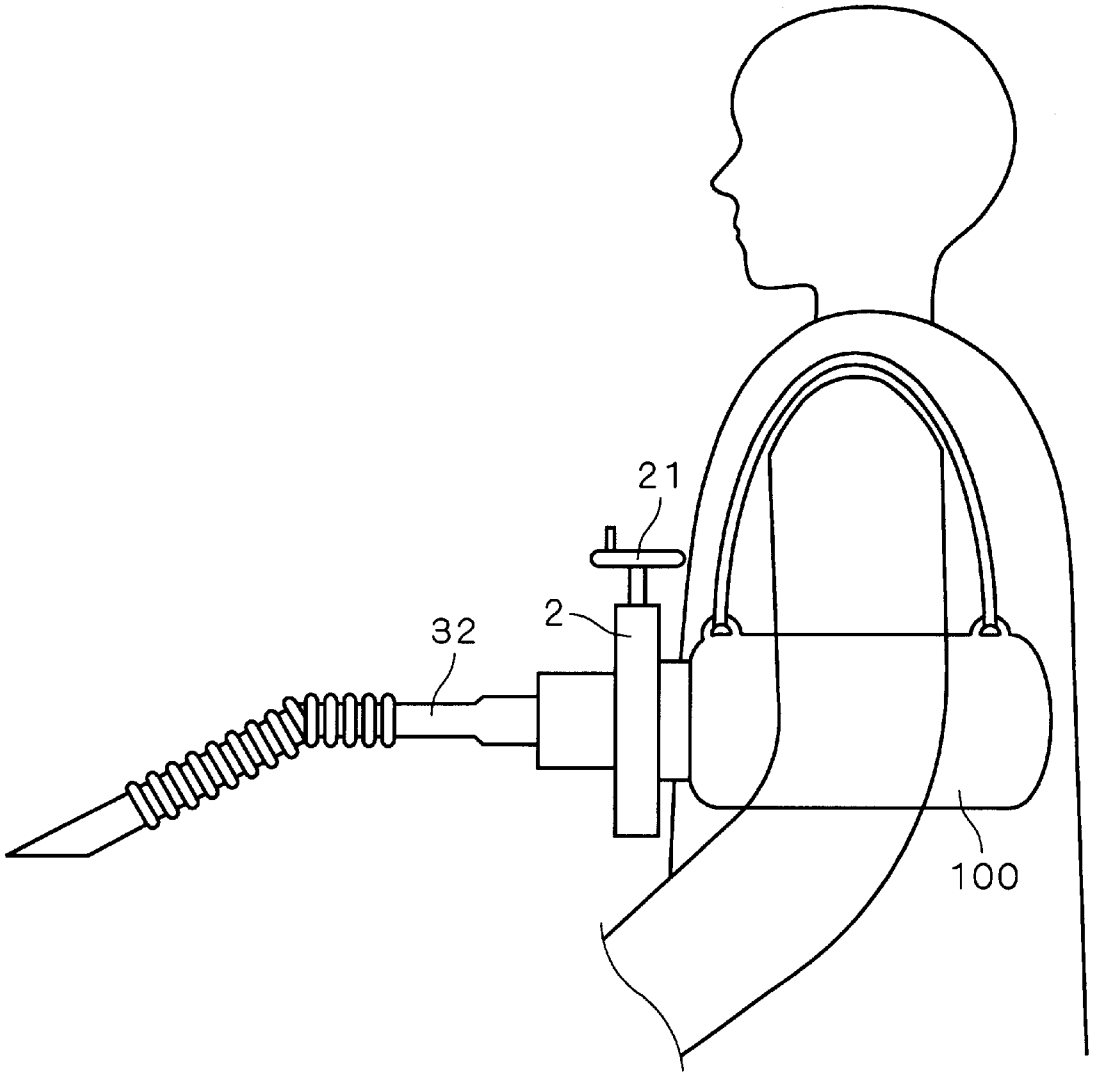
FIGS. 6 and 7 are diagrams showing examples of usage of the vacuum cleaner of the preferred embodiment of the invention.

Next, an example of usage of the vacuum cleaner 100 is described referring to FIG. 6. When the vacuum cleaner 100 uses a vacuum tank 1 with a volume of about 1 to 3 liters, the operator can carry it on the shoulder or on the back during operation. FIG. 6 shows an operator with the vacuum cleaner 100 hanging from the shoulder, where the operator can operate the suction hose 32 by one hand and the handle 21 of the valve 2 by the other, thereby conveniently controlling the opening/closing of the valve 2.

Figure 7:
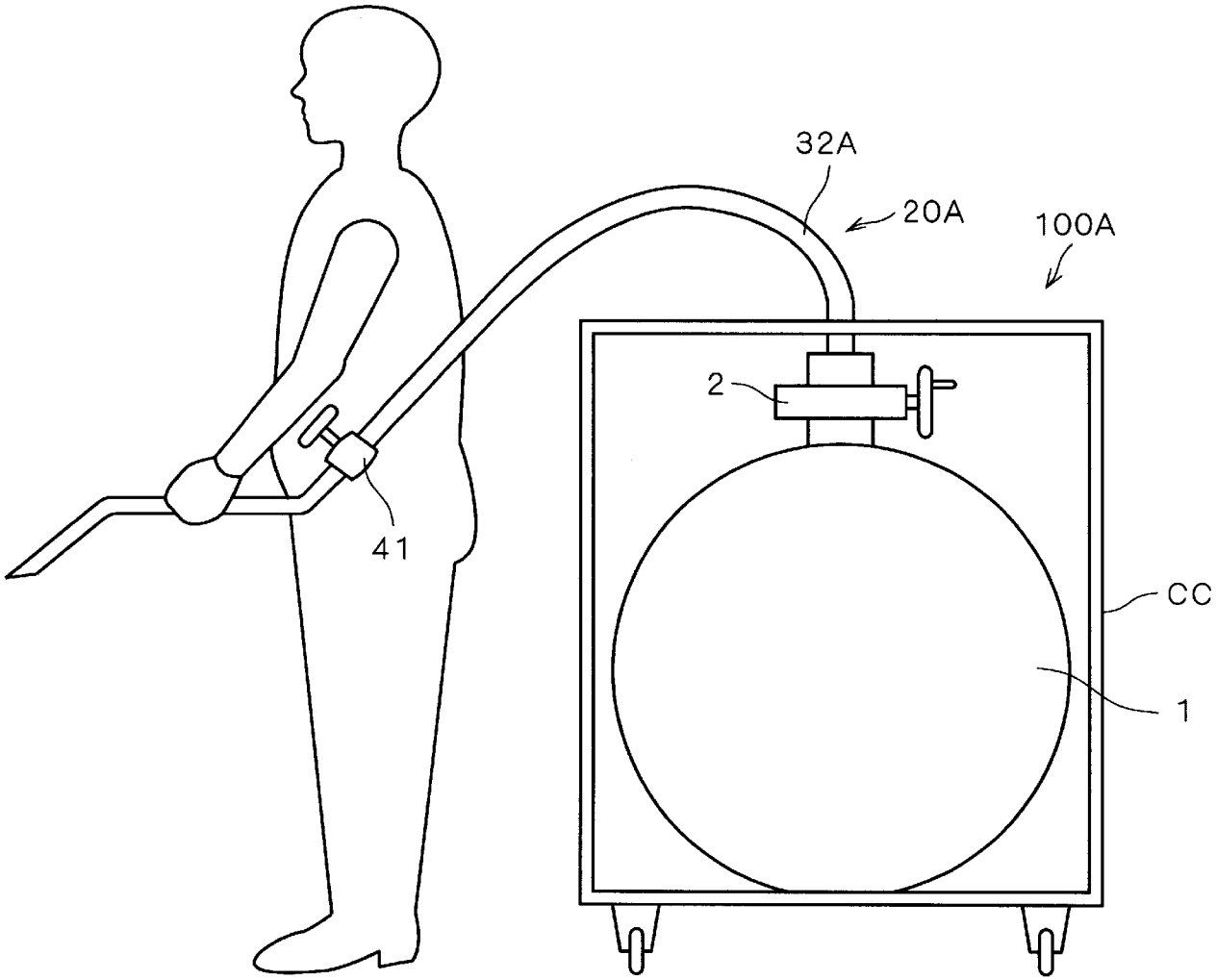

FIG. 7 shows a vacuum cleaner 100A using a vacuum tank 1 with a larger volume; it is carried on a movable cart.

The vacuum cleaner 100A shown in FIG. 7 has a vacuum tank 1 having a volume of 10 liters or more; the vacuum tank 1 is carried on a cart CC which can be freely moved. The valve 2 can be structured in the same way as that of the vacuum cleaner 100, but the suction hose 32 is replaced by a suction hose 32A having an opening/closing valve 41 located near the hand position of the operator.

The opening/closing valve 41 is a valve which, when closed, keeps airtight the part from the opening/closing valve 41 to the vacuum tank 1A. This is constructed to be quickly opened and closed, but, unlike the valve 2, does not necessarily require the function of adjusting the volume of suction.

Figure 8:
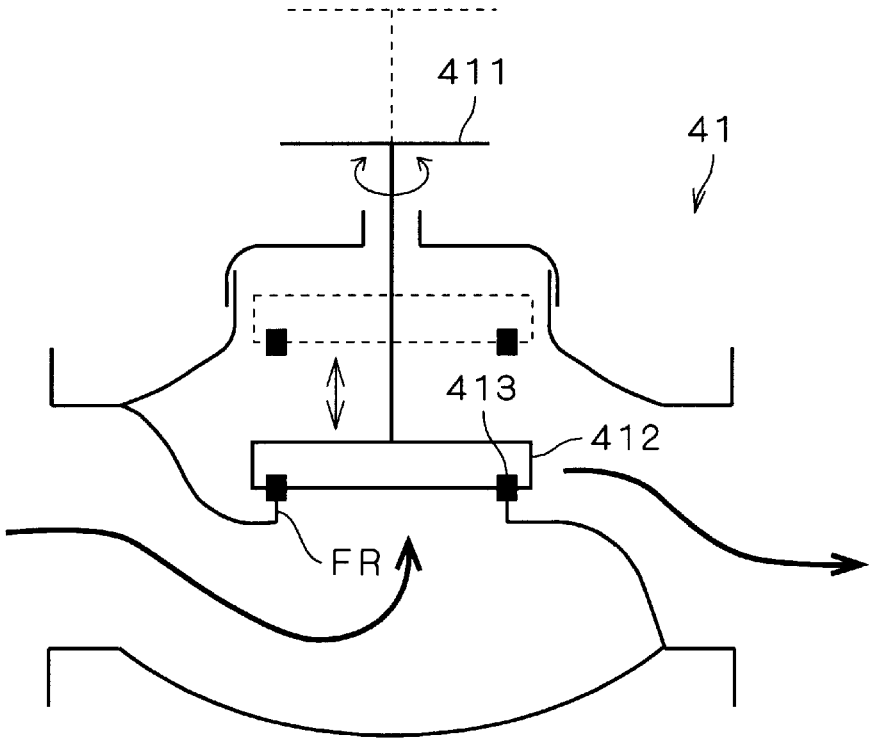
FIG. 8 is a diagram showing the structure of a valve which can be used in the vacuum cleaner of the preferred embodiment of the invention.

FIG. 8 shows an example of the opening/closing valve 41. The valve shown in FIG. 8 is called an S-type valve since the gas flows in an S-shaped passage.

In FIG. 8, the valve element 412, for closing the air passage FR, is opened/closed by rotating the handle 411. When the valve element 412 is closed, the seal member 413 provided on the valve element 412 keeps airtightness.

The S-type valve shown in FIG. 8 has the simple plate-like valve element 412 which can implement only two states: open and closed. The volume of suction can be adjusted at the hand of the operator when a valve element of a different shape is used, for example by using a known S-type valve having a valve element which can be located to vary the opening area of the passage FR.

The structure with the opening/closing valve 41 provided at the hand of the operator shown in the vacuum cleaner 100A can be adopted also when the vacuum cleaner 100 is constructed to be carried on the back of the operator.

<C. Reuse of the Vacuum Tank>

As already stated, the volume of the vacuum tank 1 is limited and the suction is disabled when the pressure in the vacuum tank 1 has regained atmospheric pressure. However, when the vacuum tank 1 has regained atmospheric pressure, it can be reused repeatedly when it is connected to a vacuum pump to create a vacuum again.

That is to say, the connection adapter 31 is removed from the vacuum cleaner 100 after use and the connection inlet 23 is connected to the evacuating line of an evacuating system. The vacuum tank 1 is then evacuated with the valve 2 opened and the valve 2 is closed when the pressure in the vacuum tank 1 has attained a given pressure, e.g. $1\times10^{-4}\times$ 133 Pa as mentioned above, and the vacuum tank 1 can then be used again.

Needless to say, it is desirable to clean the inside of the vacuum tank 1 by removing collected particles before renewing the vacuum tank 1. While a vacuum suction apparatus etc. can be used for this purpose, renewing the vacuum tank 1 does not require use of a special vacuum suction apparatus since it is done in a place outside the clean room.

When the filter 24 is provided in the connection inlet 23, it will be removed prior to the evacuation of the vacuum tank 1 so that it can be evacuated in a shorter time. The running cost can be reduced by using a filter 24 which can be renewed and used again.

As for the degree of vacuum in the vacuum tank 1, it does not have to be a high vacuum but can be a pressure of about one hundredth of atmospheric pressure, since the vacuum is produced only to create a suction force through pressure difference. The degree of vacuum of about one hundredth of atmospheric pressure is within the range which a so-called oil sealed rotary pump can achieve, so that the vacuum tank 1 can be evacuated with a simply-structured lower-price evacuation system.

When the degree of vacuum in the vacuum tank 1 is set to about one hundredth of atmospheric pressure, the material of the vacuum tank 1 can be chosen in a wide range. That is to say, as the pressure in the vacuum tank 1 becomes lower, the gas discharged from the inner wall surface of the vacuum tank 1 and the gas attached on the inner wall surface of the vacuum tank 1 become less negligible, and a metal, such as stainless steel, must be used as the material of the vacuum tank 1. However, a resin etc. can be used when the degree of vacuum is about one hundredth of atmospheric pressure. A vacuum tank which can endure the pressure of atmosphere can be easily obtained by forming it thicker than when a metal is used or by providing a reinforcing structure inside.

Forming the vacuum tank 1 with a light material like a resin reduces the weight of the vacuum cleaner 100, lessening the burden of the operator. This also reduces the manufacturing cost of the vacuum tank 1, which leads to reduction of the running cost when the vacuum cleaner 100 is used with vacuum tanks 1 replaced by one another.

<D. Variations of Vacuum Tank>

The vacuum cleaners 100 and 100A shown in FIGS. 1 and 7 have shown structures in which the valve 2 is directly connected to the vacuum tank 1. However, when the valve 2 is a gate valve that can be adjusted to adjust the state of the opening, for example, preparing a plurality of such valves cost high and is not desirable in respect of the running costs of the vacuum cleaners 100 and 100A.

Figure 9:
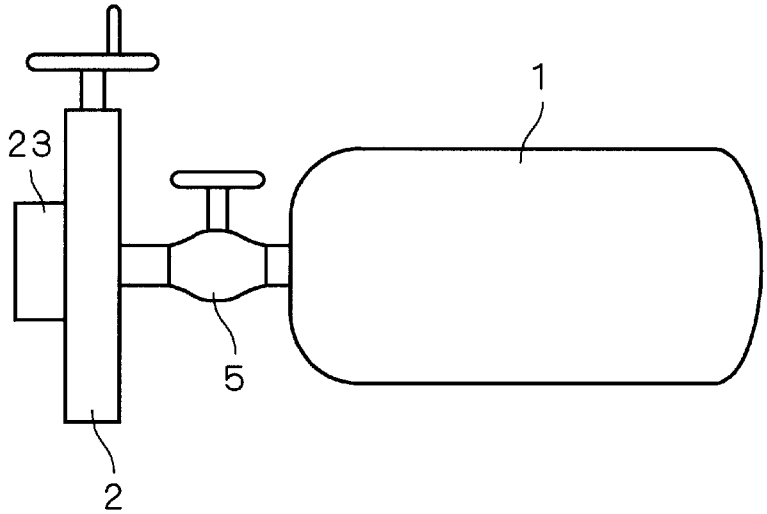
FIG. 9 is a diagram showing a variation of the vacuum cleaner of the preferred embodiment of the invention.

The running costs can be reduced by using a structure in which, as shown in FIG. 9, an opening/closing valve 5 with a simple structure is interposed between the vacuum tank 1 and the valve 2, where the opening/closing valve 5 and the vacuum tank 1 are removed/attached together when the vacuum tank 1 is replaced with a new one.

While an S-type valve as shown in FIG. 8 can be used as the opening/closing valve 5, any valve can be used as long as it provides a large passage for the gas and can be quickly opened and closed.

The costs can be reduced also by using, for the valve 2, an S-type valve capable of varying the opening area for the passage of gas as explained earlier.

In this case, needless to say, the opening/closing valve 5 as shown in FIG. 9 is not necessary and the aforementioned S-type valve providing variable opening area for the gas passage is directly connected to the vacuum tank 1. Also needless to say, a gate valve can be used as the valve 2.

<E. Functions and Effects>

As explained so far, the vacuum cleaners 100 and 100A of this invention create a suction force through a difference between the inner pressure in the vacuum tank 1 which is lower than atmospheric pressure and the external atmospheric pressure and suck up dirt and dust particles. Therefore the suction does not involve discharge of gas at all, and the vacuum cleaners can be used in extremely clean environments, such as a semiconductor device manufacturing factory, a hospital, a sterilized room, etc. Furthermore, the structure for producing the suction force is formed of only the vacuum tank 1, providing compact vacuum cleaners with simple structure. Moreover, the vacuum cleaners are suitable also for suction of fluids as well as solids, since they do not use a motor.

While the invention has been described in detail, the foregoing description is in all aspects illustrative and not restrictive. It is understood that numerous other modifications and variations can be devised without departing from the scope of the invention.

What is claimed is:

1. A vacuum cleaner comprising:

a vacuum tank having an opening;

a first valve connected to said opening of said vacuum tank and having a common connection inlet used for both evacuation of said vacuum tank to create a vacuum therein and suction of exterior contaminants into said vacuum tank; and a suction unit detachably connected to said common connection inlet of said first valve, said suction unit defining a passage through which said exterior contaminants are sucked;

wherein said first valve is capable of keeping said vacuum tank airtight by closing said common connection inlet after evacuating said vacuum tank through said common connection inlet.

2. The vacuum cleaner according to claim 1, wherein said first valve has an adjustable opening, and a suction force by which said exterior contaminants are sucked through said passage is adjustable by adjusting an opening area of said first valve.

3. The vacuum cleaner according to claim 2, wherein said first valve is a gate valve having a gate valve element, and said adjustable opening is adjusted by adjusting an area in which said gate valve element covers said adjustable opening.

4. The vacuum cleaner according to claim 1, further comprising:

a second valve provided upstream of said first valve in the flow of said exterior contaminants, said second valve having an adjustable opening, wherein said suction unit is connected to said second valve, and a suction force by which said exterior contaminants are sucked through said suction unit is adjustable by adjusting an opening area of said second valve.

5. The vacuum cleaner according to claim 4, wherein said second valve is a gate valve having a gate valve element, and said adjustable opening is adjusted by adjusting an area in which said gate valve element covers said adjustable opening.

6. A vacuum cleaner as in claim 1, wherein said common connection inlet is configured to be detachably connected to an evacuation system to perform evacuation of said vacuum tank to create the vacuum therein.

* * * * *